United States Patent [19]

Trotta et al.

[11] Patent Number: 5,036,587

[45] Date of Patent: Aug. 6, 1991

[54] RAZOR BLADE ASSEMBLY

[75] Inventors: Robert A. Trotta, Pembroke; Frederick R. Borden, Brockton, both of Mass.

[73] Assignee: The Gillette Co., Boston, Mass.

[21] Appl. No.: 575,323

[22] Filed: Aug. 29, 1990

[51] Int. Cl.[5] ..... B26B 19/44

[52] U.S. Cl. ..... 30/41; 30/84

[58] Field of Search ..... 30/41, 47–50, 30/84

[56] References Cited

U.S. PATENT DOCUMENTS

| | | | |
|---|---|---|---|
| 3,786,563 | 1/1974 | Dorion, Jr. | 30/50 |
| 3,872,592 | 3/1975 | Iten | 30/346 |
| 4,170,821 | 10/1979 | Booth | 30/41 |
| 4,573,266 | 3/1986 | Jacobson | 30/41 |
| 4,586,255 | 5/1986 | Jacobson | 30/41 |
| 4,587,729 | 5/1986 | Jacobson | 30/41 |
| 4,683,096 | 7/1987 | Ferraro | 264/249 |
| 4,697,342 | 10/1987 | Ferraro | 30/41 |
| 4,970,784 | 11/1990 | Althaus et al. | 30/50 X |

*Primary Examiner*—Douglas D. Watts

*Attorney, Agent, or Firm*—Lorusso & Loud

[57] ABSTRACT

A razor blade assembly comprising a first body member, a blade disposed on the first body member, guard and cap skin engaging surfaces on the first body member, one of the skin engaging surfaces having a groove therein, and a second body member slidable into and out of the groove, the second body member comprising a shaving aid strip.

21 Claims, 4 Drawing Sheets

RAZOR BLADE ASSEMBLY

BACKGROUND OF THE INVENTION

1. Field of the Invention

This invention relates to a blade assembly for a wet-shave type razor and is directed more particularly to a blade assembly having thereon a replaceable shaving aid body.

2. Description of the Prior Art

It is known in the prior art to provide a razor blade assembly with a shaving aid strip affixed to one of the skin engaging components of the assembly. In U.S. Pat. No. 4,573,266, issued Mar. 4, 1986, to Chester F. Jacobson, for example, there is shown such a strip attached to a blade assembly cap portion. The shaving aid comprises a formed mixture of a hydrophobic material and a water leachable hydrophilic material, which may serve as a lubricant, moisturizer, conditioner, or the like. During shaving, water present activates and causes leaching out of the hydrophilic material.

U.S. Pat. No. 4,586,255, issued May 5, 1986, to Chester F. Jacobson, and U.S. Pat. No. 4,587,729, issued May 13, 1986, to Chester F. Jacobson, are further examples of razor blade cartridges having shaving aid members attached thereto.

It has been suggested in the prior art, as for example, in U.S. Pat. No. 4,170,821, issued Oct. 16, 1979, to Anthony M. Booth, that the shaving aid may be one of any available diverse materials appropriate for diverse applications, such as a lubricating agent, a depilatory agent, a cleaning agent, a medicinal agent, a cosmetic agent, and the like. In practice, shaving aid strips available to the public are of the lubricating type. Razor blade assemblies are provided with shaving aids of the lubricating type because lubrication of the skin is desired almost all the time, whereas the other possible attributes of shaving aids, such as a medicinal attribute, for example, may be desirable only occasionally.

Accordingly, it would be beneficial to provide a blade assembly in which the shaving aid is replaceable, such that for given occasions a specialized shaving aid may be substituted for a lubricating shaving aid for one or two shaves, and thereafter the specialized shaving aid replaced by the previous, or another, lubricating shaving strip.

SUMMARY OF THE INVENTION

It is, therefore, an object of the invention to provide a blade assembly having a replaceable shaving aid strip, such that a plurality of strips may be used with a given blade means.

With the above and other objects in view, as will hereinafter appear, a feature of the present invention is the provision of a razor blade assembly comprising a first body member, blade means disposed on the first body member, the first body member having skin engaging surfaces comprising a guard portion adapted to precede the blade means in a shaving stroke and a cap portion adapted to follow the blade means in the shaving stroke, one of the skin engaging surfaces having an open-ended groove therein, and a second body member adapted to slide into and out of the groove, the first body member and the second body member being adapted to interconnect, whereby the second body member is releasably retained in the groove.

In accordance with a further feature of the invention, the second body member comprises an elongated member having shaving aid means thereon.

The above and other features of the invention, including various novel details of construction and combination of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
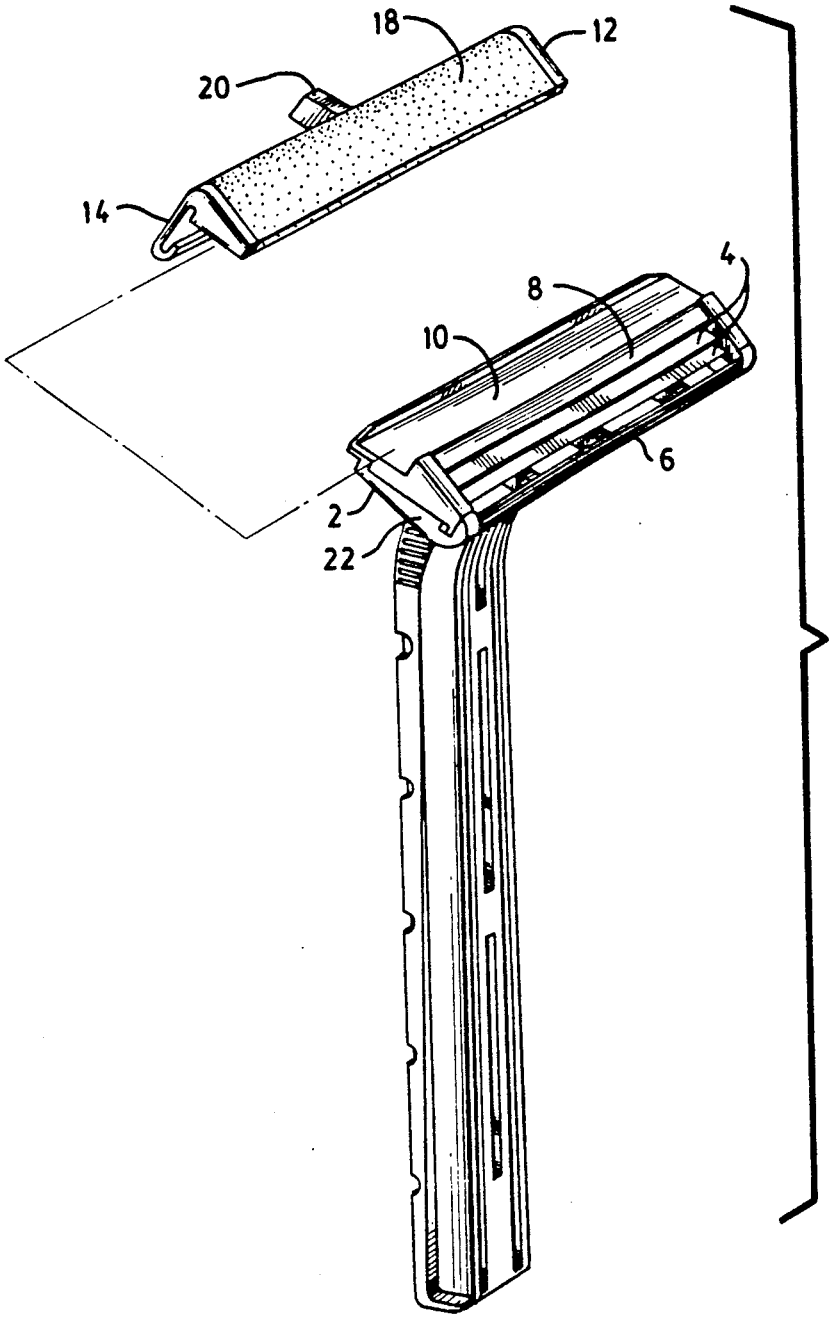
FIG. 1 is a perspective view of one form of razor blade assembly illustrative of an embodiment of the invention.
Figure 2:
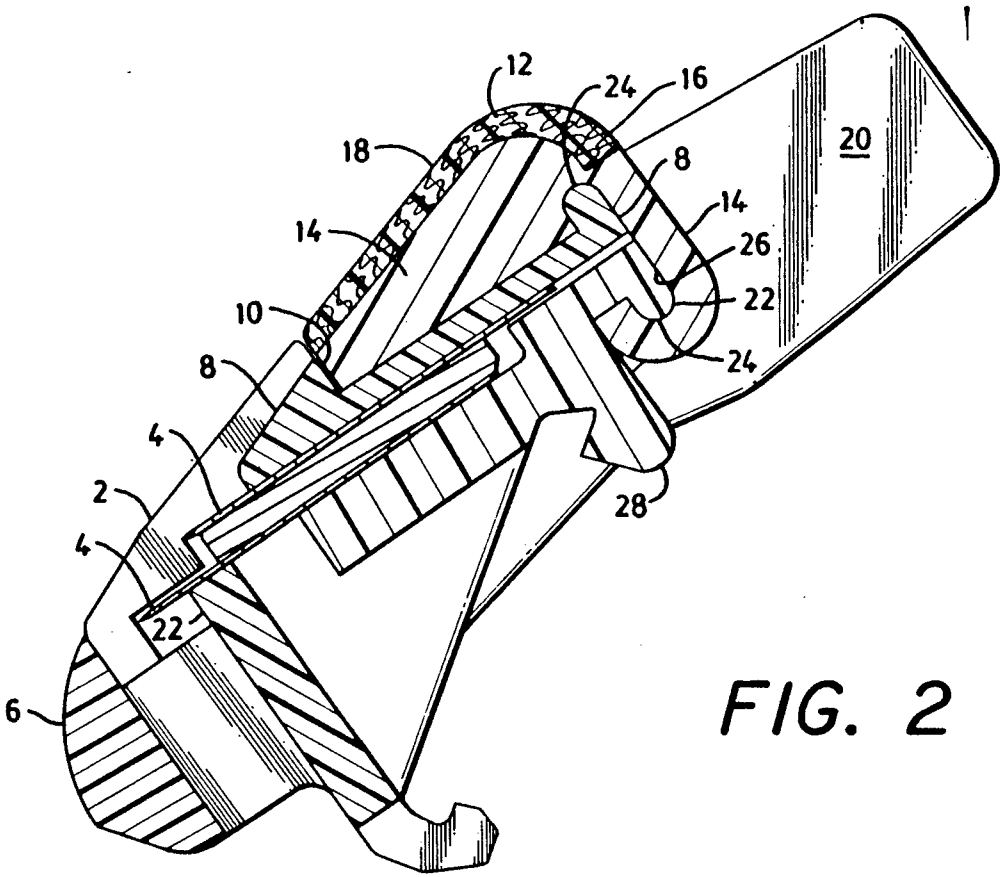
FIG. 2 is an end view of the razor blade assembly shown in FIG. 1, with cap and platform portions shown in section.

Referring to the drawings, and particularly to FIGS. 1 and 2, it will be seen that the illustrative razor blade assembly includes a first body member 2, having blade means 4 disposed thereon. The first body member 2 is further provided with skin engaging portions comprising a guard portion 6 adapted to precede the blade means 4 in a shaving stroke, and a cap portion 8 adapted to follow the blade means in the shaving stroke. One of the skin engaging portions 6, 8 is provided with an open ended groove 10. In the illustrated embodiment, the groove 10 is located in the cap portion 8 of the assembly.

The razor blade assembly includes a second body member 12 adapted to slide into, and out of, the groove 10. The first body member 2 and the second body member 12 are thus adapted to interconnect, the second body member 12 being releasably retained in the first body member groove 10.

Figure 3:
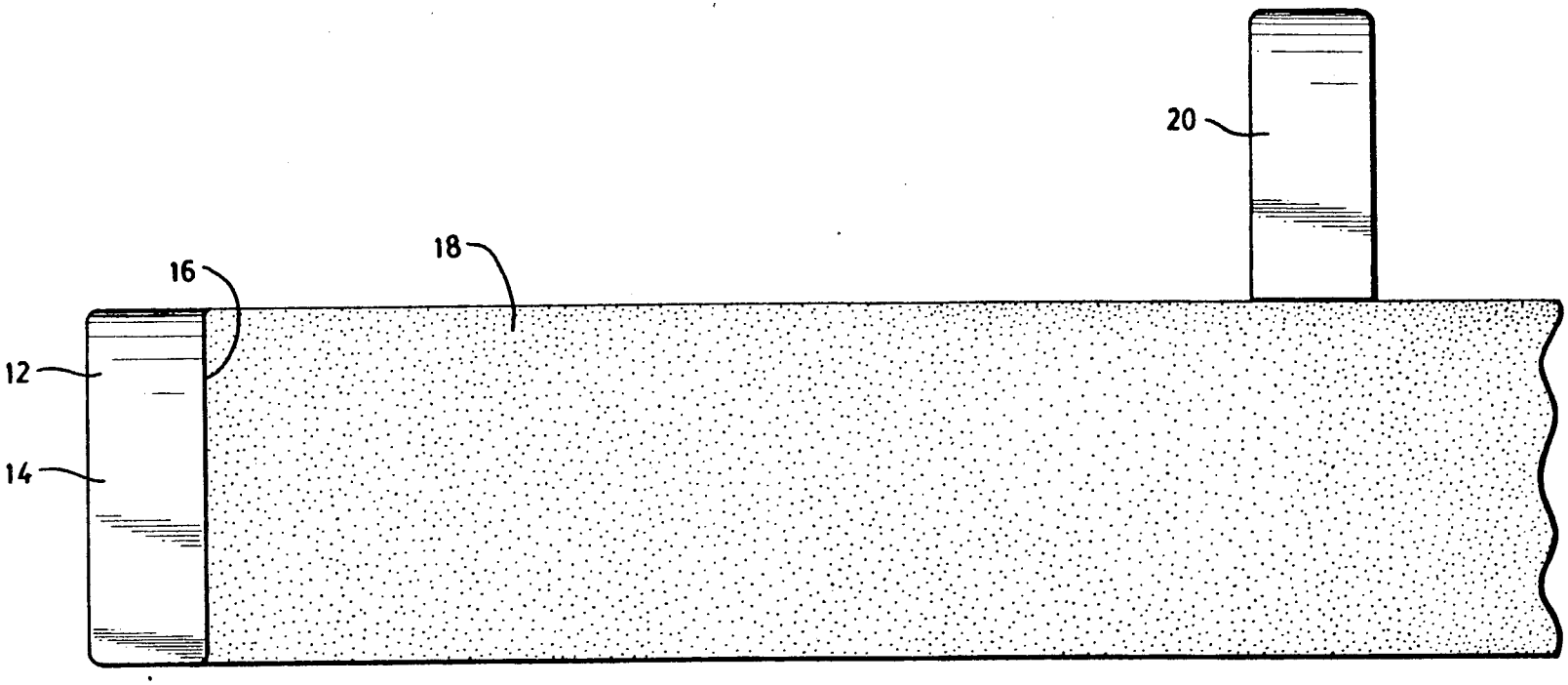
FIG. 3 is a top plan view of a portion of the strip member of the illustrative blade assembly.
Figure 4:
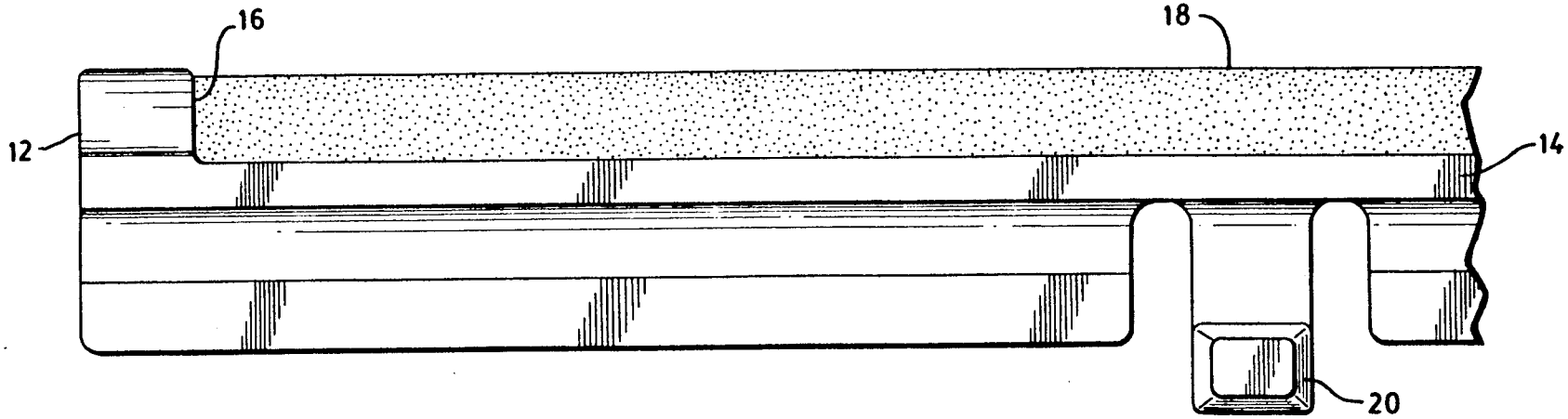
FIG. 4 is a front elevational view of the portion of the strip member of FIG. 3.

The second body member 12 may comprise in its entirety a shaving aid body, that is, the entire second body member may have contained therein the aforementioned leachable material. Alternatively, and as illustrated in FIGS. 3 and 4, the second body member 12 may comprise a base portion 14 having a shaving aid strip 18 fixed thereto. The base portion 14 may have a recess 16 therein with the shaving aid strip 18 disposed in the recess, or may have the shaving aid strip attached to the base portion by adhesive, mechanical locking means, or by a two-step molding process, all known in the art.

When in place on the first body member 2, the second body member 12, and particularly the shaving aid strip portion 18 thereof, is adapted for engagement with a surface being shaved. The second body member 12 is readily slidable on the first body member 2. To facilitate such sliding action, the base portion 14 of the second body member 12 is provided with a grip portion, which may be an integrally molded tab 20 extending rearwardly from the base portion 14.

Referring again to FIGS. 1 and 2, it will be seen that the illustrative blade assembly first body member 2 includes a platform portion 22, which is connected to the guard portion 6, with the blade means 4 being disposed between the platform portion 22 and the cap portion 8. In FIG. 2 it will be seen that the platform and cap portions 22, 8, cooperate to form a T-shaped rail 24, comprising a first slide means, which extends parallel to the guard and the blade edges and faces rearwardly. The second body portion 12 is provided with a complementarily shaped second slide means 26, in the form of a T-shaped slot, adapted to receive the rail 24 and to slide endwise along the rail on the back of the blade assembly.

In operation, the blade assembly, comprising the first and second body portions, is used in wet shaving in a manner well known. When the operator wishes to substitute a specialized shaving aid material for a lubricating shaving aid, for example, the second body member 12 is slid off the first body member 2, by use of the tab 20. A new second body member is inserted in the groove 10 and onto the rail 24 and slid endwise into place on the blade assembly. The second body member is retained against endwise movement by friction, there being no endwise force on the second body member during shaving. The second body member is retained against movement forwardly or rearwardly by the groove and rail arrangement described above.

The blade assembly may be provided with connection means 28 (FIG. 2) for releasable attachment to a razor handle, or may be permanently attached to a handle, as is common in "disposable" razors.

It is to be understood that the present invention is by no means limited to the particular construction herein disclosed and/or shown in the drawings, but also comprises any modification or equivalents within the scope of the claims. For example, while the above description has been directed primarily to shaving aids of the chemical type, that is, 1 shaving aid bodies having a chemical component which is water activatable and leaches out to deposit on the skin, it is also contemplated that shaving aid bodies of the mechanical type could be selectively used in the present invention. In PCT U.S. patent application Ser. No. 89/04588, filed Oct. 13, 1989, there are disclosed a number of skin engaging surfaces for providing frictional sensations to a surface being shaved. Using the present invention, an operator is able to switch from a given cap surface, for example a very rough surface, to another cap surface, for example a very smooth surface. Second body members of different skin engaging surface configurations may also be used to change shaving geometries of blade assemblies. A second body member, for example, having a peak on its skin engaging surface would have the effect of decreasing the "exposure" of the blade means, as that term is defined in U.S. Pat. No. 3,786,563. A second body member slidable onto the guard portion of a blade assembly may be used to change the skin engaging surface characteristic of the guard portion of the blade assembly, as from rough to smooth, plastic to metal, and the like.

Having thus described our invention, what we claim as ne and desire to secure by Letters Patent of the United States is:

1. A razor blade assembly comprising a first body member, blade means disposed on said first body member, said first body member having skin engaging surfaces comprising a guard portion adapted to precede said blade means in a shaving stroke and a cap portion adapted to follow said blade means in said shaving stroke, one of said skin engaging surfaces having an open-ended groove therein, and a second body member adapted to slide into and out of said groove, said first body member and said second body member being adapted to interconnect, whereby said second body member is releasably retained in said groove.

2. The razor blade assembly in accordance with claim 1 in which said second body member comprises a shaving aid strip adapted for engagement with a surface being shaved.

3. The razor blade assembly in accordance with claim 1 in which said second body member comprises an elongated member, and is adapted to slide endwise into and out of said groove.

4. The razor blade assembly in accordance with claim 3 in which said elongated member comprises a shaving aid strip adapted for engagement with a surface being shaved.

5. The razor blade assembly in accordance with claim 3 in which said elongated member comprises a base portion having a recess therein, and a shaving aid strip fixed in said base portion recess, said shaving aid strip being adapted for engagement with a surface being shaved.

6. The razor blade assembly in accordance with claim 5 in which said elongated member is provided with a grip portion by which said elongated member may be manipulated into and out of said groove.

7. The razor blade assembly in accordance with claim 1 in which said first body member includes a platform portion connected to said guard portion, said blade means being disposed between said platform portion and said cap portion, said platform and cap portions cooperating to form a rail extending parallel to said guard portion and facing rearwardly, and said second body portion having slide means therein adapted to receive said rail and slide along said rail on the back of said blade assembly.

8. The razor blade assembly in accordance with claim 7 in which said second body member comprises a shaving aid strip adapted for engagement with a surface being shaved.

9. The razor blade assembly in accordance with claim 7 in which said second body member comprises a base portion having a recess therein, and a shaving aid strip fixed in said base portion recess, said shaving aid strip being adapted for engagement with a surface being shaved.

10. The razor blade assembly in accordance with claim 9 in which said second body member is provided with a grip portion by which said second body member may be manipulated into and out of said groove.

11. The razor blade assembly in accordance with claim 10 in which said grip means comprises a tab extending from said second body member base portion.

12. The razor blade assembly in accordance with claim 7 in which said first body member rail is T-shaped and said second body member slide means comprises a T-shaped slot adapted to receive said rail, whereby said second body member is moveable only endwise on said first body member.

13. The razor blade assembly in accordance with claim 12 in which said second body member comprises a shaving aid strip adapted for engagement with a surface being shaved.

14. The razor blade assembly in accordance with claim 12 in which said second body member comprises a base portion having a shaving aid strip fixed thereto, said base portion having said T-shaped slot therein.

15. The razor blade assembly in accordance with claim 14 in which said base portion is provided with a grip portion by which said second body member may be manipulated into and out of said groove.

16. The razor blade assembly in accordance with claim 15 in which said grip portion comprises a tab extending from said second body member base portion.

17. The razor blade assembly in accordance with claim 6 in which said grip portion comprises a tab extending from said elongated member.

18. A razor blade assembly comprising a first body member, blade means disposed on said first body member, said first body member having skin engaging portions adapted to precede and follow, respectively, said blade means in a shaving stroke, said first body member having on one of said skin engaging portions a first slide means, and a second body member adapted to slide onto and off of said first slide means, said second body member having a skin engaging surface thereon.

19. The razor blade assembly in accordance with claim 18 in which said second body member comprises a shaving aid strip.

20. The razor blade assembly in accordance with claim 18 in which said second body member comprises a base portion and a shaving aid portion fixed to said base portion.

21. The razor blade assembly in accordance with claim 18 in which said second body member is provided with a grip portion.

* * * * *